US008096087B2

(12) United States Patent
Wainland

(10) Patent No.: US 8,096,087 B2
(45) Date of Patent: Jan. 17, 2012

(54) OVERLYING MEMBER TO SUPPORT ASSEMBLY CONNECTION

(76) Inventor: Robert Andrew Wainland, Coral Springs, FL (US)

( * ) Notice: Subject to any disclaimer, the term of this patent is extended or adjusted under 35 U.S.C. 154(b) by 1225 days.

(21) Appl. No.: 11/705,216

(22) Filed: Feb. 12, 2007

(65) Prior Publication Data

US 2008/0191110 A1 Aug. 14, 2008

(51) Int. Cl.
*E04B 5/43* (2006.01)

(52) U.S. Cl. ..... 52/177; 108/42; 108/47; 108/157.1

(58) Field of Classification Search ..... 52/177, 52/179, 180, 126.5, 126.6, 263; 108/42, 108/47, 56.3, 57.26, 57.33; 248/250
See application file for complete search history.

(56) References Cited

U.S. PATENT DOCUMENTS

| | | | | | |
|---|---|---|---|---|---|
| 2,583,838 | A | * | 1/1952 | Hart | 108/42 |
| 2,607,301 | A | * | 8/1952 | Lundvall | 52/664 |
| 2,607,971 | A | * | 8/1952 | Bedford, Jr. | 52/713 |
| 2,841,350 | A | * | 7/1958 | Chronister | 108/56.3 |
| 3,318,057 | A | * | 5/1967 | Norsworthy | 52/126.6 |
| 3,852,928 | A | * | 12/1974 | Raith | 52/263 |
| 3,875,597 | A | * | 4/1975 | McGaffin et al. | 4/578.1 |
| 3,995,593 | A | | 12/1976 | Bowser | |
| 4,142,341 | A | * | 3/1979 | Mott | 52/263 |
| 4,255,914 | A | | 3/1981 | Seipos | |
| 4,446,660 | A | | 5/1984 | Miller et al. | |
| 4,879,856 | A | | 11/1989 | Jones et al. | |
| 5,058,352 | A | | 10/1991 | Loiselle et al. | |
| 5,239,790 | A | | 8/1993 | Fetzer | |
| 5,275,367 | A | * | 1/1994 | Frye | 248/250 |
| 5,388,533 | A | * | 2/1995 | Pigott et al. | 108/56.3 |
| 5,544,459 | A | | 8/1996 | Konger | |
| 5,628,153 | A | | 5/1997 | Fontanez | |
| 5,836,133 | A | | 11/1998 | Bergeron et al. | |
| 5,845,979 | A | | 12/1998 | Longhurst et al. | |
| 6,938,558 | B1 | * | 9/2005 | Peres | 108/56.3 |
| 6,968,652 | B1 | | 11/2005 | Eadie | |
| 2005/0016098 | A1 | | 1/2005 | Hahn | |
| 2005/0028469 | A1 | | 2/2005 | Grohman | |
| 2005/0204677 | A1 | | 9/2005 | Mei | |
| 2005/0258722 | A1 | | 11/2005 | Sullivan | |
| 2006/0075711 | A1 | | 4/2006 | Landey | |
| 2007/0028550 | A1 | * | 2/2007 | Clapper | 52/650.3 |

* cited by examiner

*Primary Examiner* — Basil Katcheves
*Assistant Examiner* — Matthew J Smith
(74) *Attorney, Agent, or Firm* — Malloy & Malloy, P.A.

(57) ABSTRACT

A support assembly connectable to a base structure preferably disposed in an attic or other like location of a house, dwelling, and/or other building to provide or facilitate storage and or standing, walking, or crawling thereon. The support assembly comprising at least one or a plurality of mounting devices and at least one overlying member having an upper surface and a lower surface wherein the lower surface is removably connectable to the mounting devices. The mounting devices comprising an upper portion and an attachment mechanism. The attachment mechanism being removably connectable to the base structure.

12 Claims, 13 Drawing Sheets

OVERLYING MEMBER TO SUPPORT ASSEMBLY CONNECTION

BACKGROUND OF THE INVENTION

1. Field of the Invention

This invention relates to a support assembly connected to a base structure preferably disposed in an attic or other like location of a house, dwelling, building, or other structure. As such, the support assembly may operatively provide or facilitate storage space and/or any other flooring, or covering structure. The support assembly may include at least one or a plurality of mounting devices and at least one or a plurality of overlying members cooperatively structured to be removably connected thereto. In addition, the mounting devices may include an attachment mechanism structured to be removably connectable to the base structure.

2. Description of the Related Art

Many buildings, houses, and other like structures include accessible attic compartments between the inner ceiling and roof, which typically yield a large, at least partially open area. Furthermore, the floors of many of the attics today include a plurality of spaces, which may or may not be open, defined by the beams, joists, or bottom chords of the trusses of the roof and the unprotected ceiling panels secured thereto. In addition, many of these spaces may typically be at least partially filled with insulation or other like material.

Furthermore, individuals and/or families whether living or working in the building or just merely utilizing the premises, may have the desire to store some or all of their belongings in the attic or other similar location. In addition, some individuals may want to transform or build their attic into an additional room to expand their living and/or working quarters.

Unfortunately, however, the typically structured attic is not designed or even capable of supporting heavy loads exerted from, for example, storage boxes, bags, carts, trunks, and/or individuals crawling, walking, or standing thereon. Specifically, the ceiling tile will typically crack or break when such a load is exerted thereon. Thus, the large, at least partially open areas provided by most attics are not being utilized to their fullest potential, if at all.

As such, there is a current need in the art for a support assembly structured to be operatively connected to a base structure such as, for example, the bases, or bottom chords of the trusses on the floor of an attic. The proposed support assembly may be structured to at least partially cover or protect the vulnerable spaces on the floor of the attic to provide sufficient support for heavy loads to be placed or exerted thereon.

Additionally, such a proposed support assembly may include at least one, or a plurality of mounting devices and at least one overlying member cooperatively structured to be connectable thereto. Furthermore, the mounting devices of the proposed support assembly may include an attachment mechanism structured to be removably connected to the base structure.

It would be particularly beneficial if the proposed support assembly could be operatively and removably connected to the base structure without the need for tools or other external devices. As such, the proposed support assembly may be easily assembled, mounted, and/or disassembled as desired or to fit the particular need or circumstance.

It would also be beneficial if the proposed support assembly includes a height measured between the base structure and the support assembly wherein an opening may be defined therein. Such an opening may be dimensioned to allow existing and/or subsequently installed pipes, wires, or other like structures or devices to be unobstructed by the proposed support assembly while in its operative and assembled orientation.

It would further be advantageous if the mounting device is structured to be at least partially connectable to a top chord or web of a truss, or any other similar location. As such, the mounting device may be utilized for mounting shelves, fishing rods, and/or hanging other objects or devices therefrom.

SUMMARY OF THE INVENTION

The present invention is related to a support assembly that may be connected to a base structure preferably located in an attic of a house, apartment, dwelling, or other structure, but is in no way limited to such locations. Moreover, the support assembly of the present invention may be utilized to fit a plurality of needs or circumstances including but not limited to increasing and/or adding storage space through, for example, the provision of or providing one or more supporting platforms or surfaces to facilitate an individual to stand and/or maneuver around upon. As such, the support assembly of the present invention may preferably be disposed on or across a beam or other like base structure of an attic to at least partially cover or overlie the spaces typically filled with insulation or other like material.

The support assembly of the present invention may include at least one or a plurality of mounting devices and at least one overlying member, such as a panel and/or platform. Each of the mounting devices may preferably include an upper portion and an attachment mechanism, wherein the attachment mechanism is structured to be at least partially disposed on and/or connected to the base structure. In at least one preferred embodiment of the support assembly of the present invention, the attachment mechanism is structured to at least partially overlie the base structure so as to be removably connected thereto.

In addition, the attachment mechanism of at least one embodiment of the present invention may include an irregular surface configuration which may be at least partially defined by an array of teeth. The irregular surface configuration and/or teeth may be disposed and structured to provide an at least partially gripping engagement between the attachment mechanism and the cooperatively oriented base structure.

Moreover, the attachment mechanism may further include a tightening assembly. Specifically, the tightening assembly may comprise a fastener that may either penetrate the surface of the base structure or provide an engagement therewith at least partially solely on the basis of pressure and friction. Either way, the fastener may be at least partially manipulated by hand, which may preferably be structured to minimize or completely eliminate the need for tools or other external devices to facilitate the tightening or loosening thereof. As such, the fastener may include a thumb screw or an equivalent structure. In addition, however, the fastener may include a conventional type screw which may require the utilization of a screw driver or other like tool to tighten or loosen.

Common to each of the various preferred embodiments of the support assembly of the present invention is the cooperative structuring of confronting portions of the mounting devices and the one or more panels supported thereby in order to establish a stable but removable connection therebetween. More specifically, in at least one preferred embodiment of the present invention, each of the mounting devices may include at least one or a plurality of outwardly protruding portions, such as, for example, raised tabs. The protruding portions may be structured in any number, shape, length, or orientation.

In addition, the support assembly of the present invention may further include at least one or a plurality of overlying members having an upper surface and a lower surface. The overlying member may preferably be constructed from particle board, however other materials may be utilized such as plywood, medium-density fibreboard (MDF or MDFB), metal, plastic, or any other like material.

The lower surface of the overlying member in at least one preferred embodiment of the present invention may be structured to define at least one or a plurality of receiving slots thereon. The receiving slots may be cooperatively structured such that the protruding portions of the mounting devices may be removably disposed therein. Further, the receiving slots may be structured to have a dimension slightly larger than that of the protruding portions of the mounting devices. More in particular, the length, width, and/or depth of the receiving slots may be larger, albeit only minimally, so as to allow some movement and/or adjustment of the overlying member(s) or mounting device(s).

Moreover, at least one alternate embodiment of the present invention may further include a substantially "reversed" configuration wherein the overlying member includes at least one or a plurality of protruding portions, for example, tabs disposed on or along the lower surface thereof. The protruding portions may be located substantially near the edges of the overlying member or closer to the center thereof. Additionally, the mounting devices of the "reversed" embodiment of the present invention may be structured to define at least one or a plurality of receiving slots cooperatively structured and dimensioned such that the protruding portions of the overlying member may be removably insertable therein.

Additionally, in at least one embodiment of the present invention, the mounting device may be dimensioned and configured to dispose the panel above and/or in outwardly spaced relation from the base to facilitate the placement of pipes, wiring, and other utilitarian devices between the base and corresponding panel. More in particular, the support assembly may be structured to have a height such that when the support assembly of the present invention is completely assembled and operatively disposed on the base structure, the distance between the base structure and the overlying member defines an opening therethrough. The opening may be of a sufficient dimension to allow pipes, wiring, and other like devices and structures to pass through unobstructed by the support assembly of the present invention.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
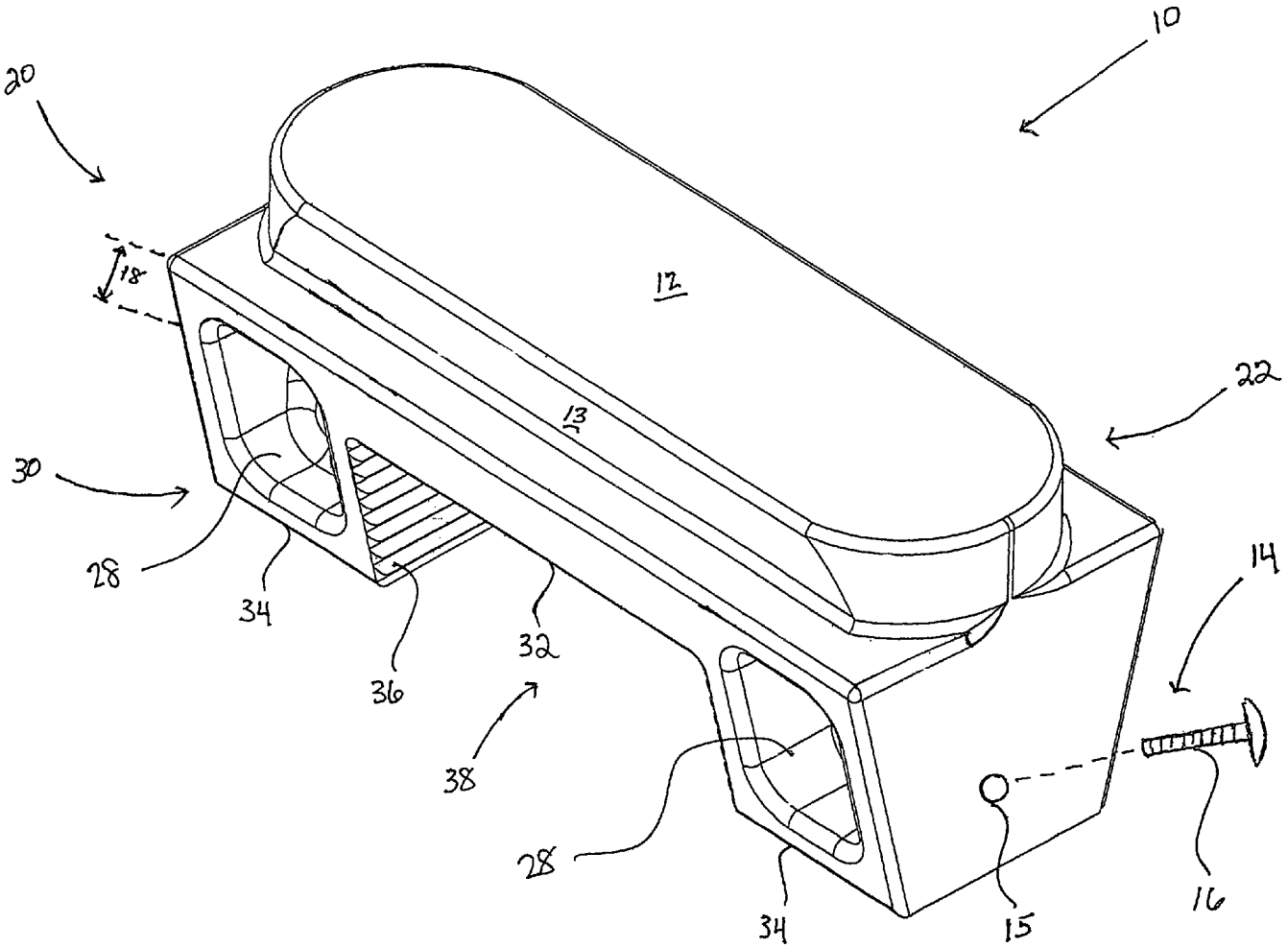
FIG. 1 is a schematic representation of a preferred embodiment of a mounting device of the present invention.

As shown in the accompanying drawings, the present invention is directed to a support assembly, generally indicated as 10, which is connectable to a base structure 50. The base structure 50 may include a beam, joist, or any portion of a truss, including but not limited to the top chord, bottom chord, and/or web. In addition, the base structure 50 may include any other structure preferably located in an attic of a house, apartment, or other dwelling, building, or structure. The base 50, however, is in no way limited to structures disposed in such locations. Accordingly, the base structure 50 may be vertically oriented, as in a wall, or disposed in any other conceivable angle. Additionally, the base structure 50 may be disposed at any height or elevation, for example, near a ceiling or roof of a house, building, etc.

As such, the support assembly 10 of the present invention is versatile in that it may be utilized to fit a plurality of needs or circumstances, including, for example, to increase storage space, or provide additional surface(s) to facilitate an individual to walk, crawl, and/or stand thereon. In addition, the support assembly 10 may provide enclosures and/or panels for ceilings, walls, etc.

As will be described in further detail below, the support assembly 10 of the present invention may preferably be disposed across and/or along the beams, joists, trusses, or other base structures 50 to at least partially cover or overlie the open spaces in an attic typically filled with insulation or other like material or objects. In addition, the base structure 50 may include any other substantially or partially stable member whether located in an attic or not.

In at least one embodiment of the present invention, the support assembly 10 may include at least one or a plurality of mounting devices 20. The mounting devices 20 may be connected to a base structure 50, such as, for example, the web and/or top chord of a truss. Accordingly, the mounting devices 20 may facilitate the mounting and/or hanging of shelves, fishing rods, or any other structures or devices therefrom.

Figure 3:
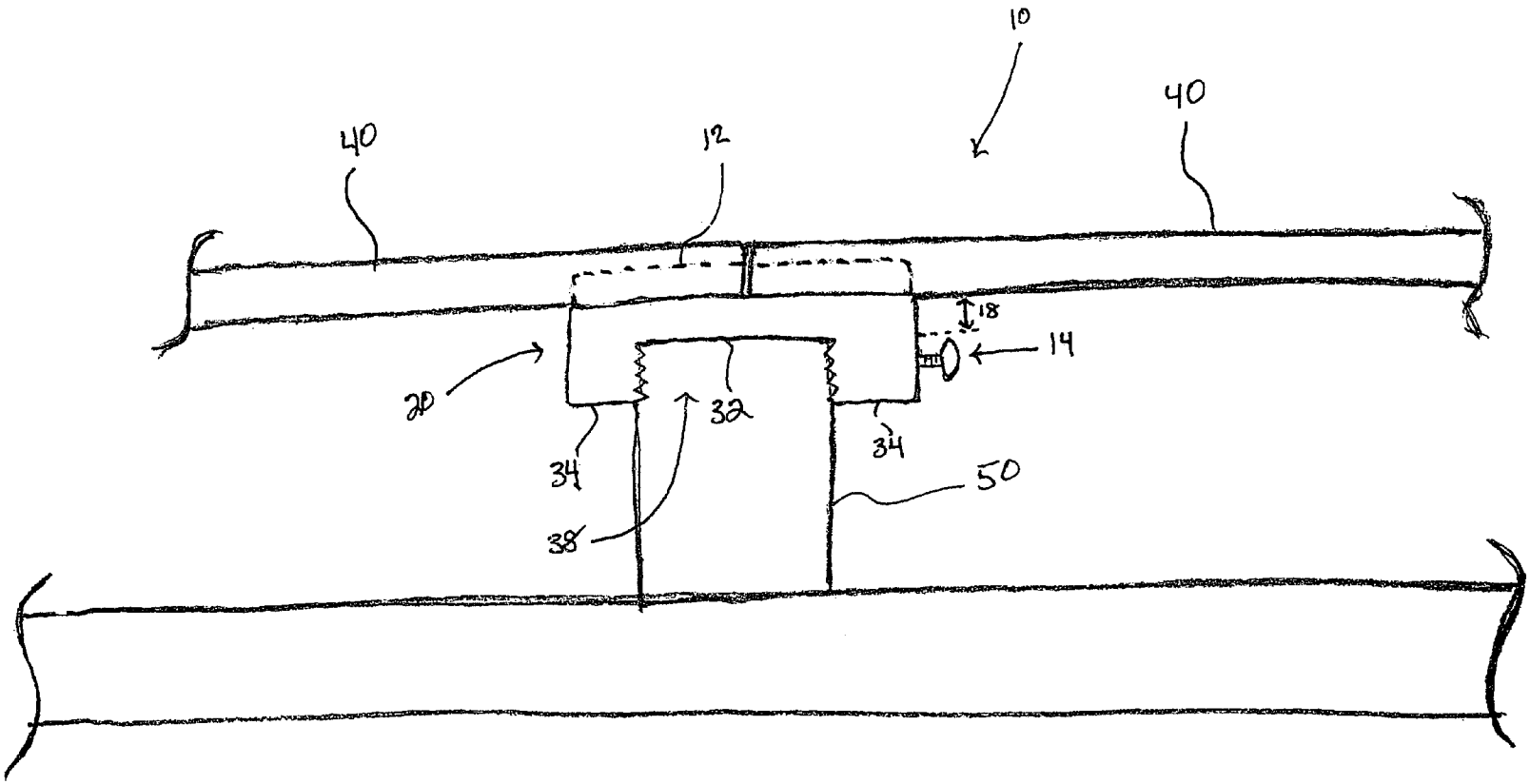
FIG. 3 is a schematic representation of a side view of a preferred embodiment of the support assembly connected to a base structure of the present invention.
Figure 3A:
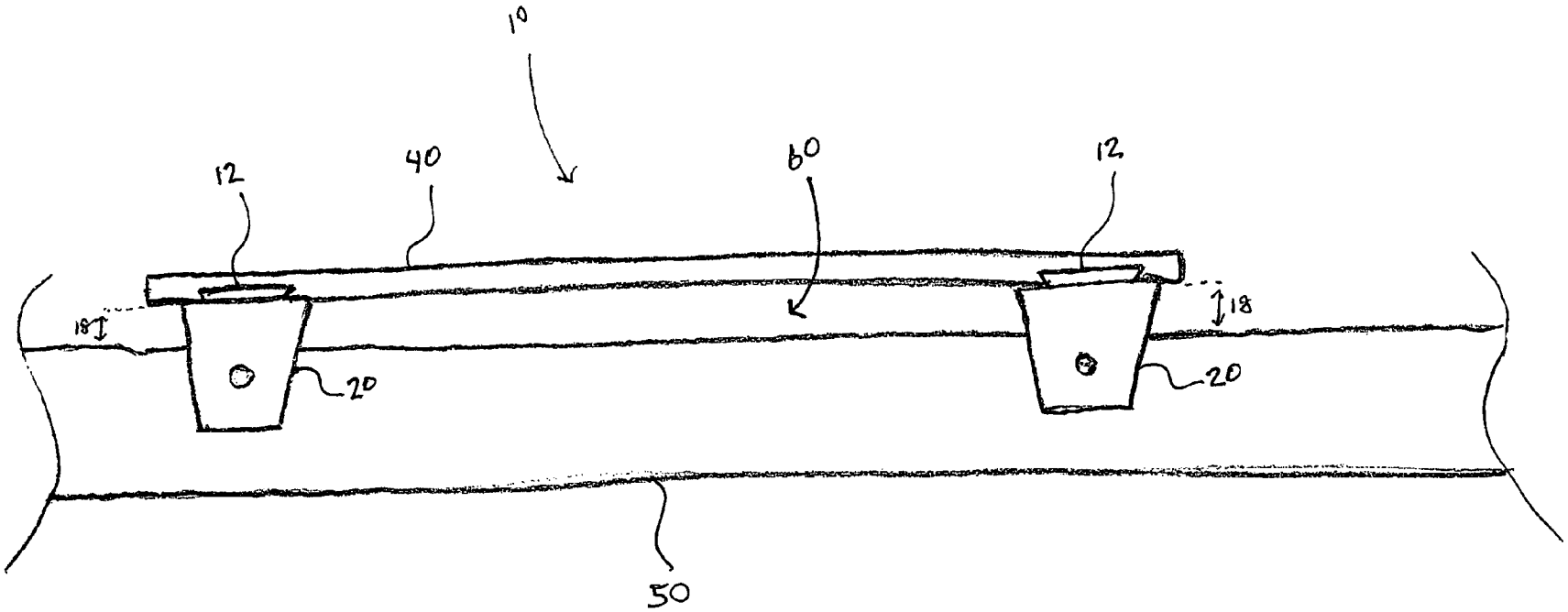
FIG. 3*a* is a schematic representation of a front view of the support assembly connectable to a base structure of FIG. 3.
Figure 3B:
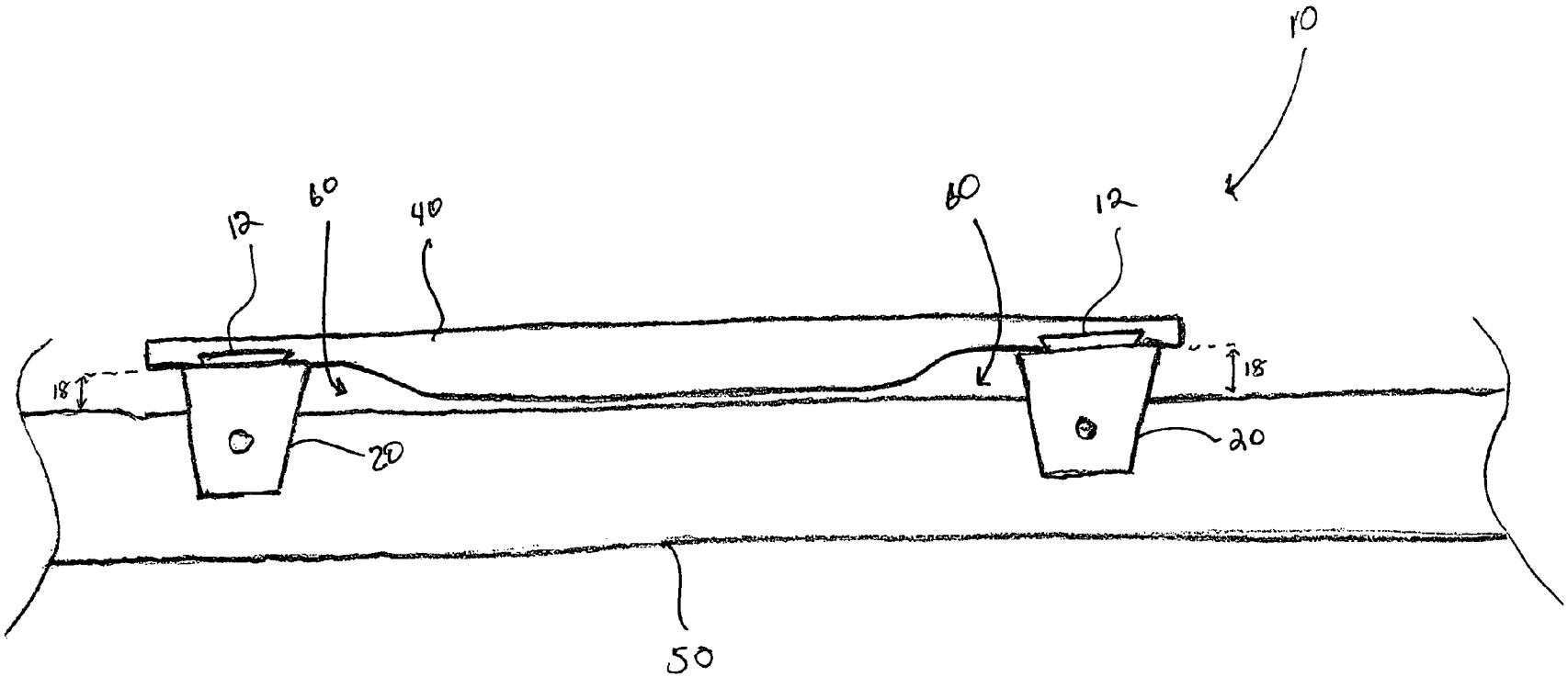
FIG. 3*b* is a schematic representation of a variation of the embodiment of the support assembly connectable to a base structure of FIG. 3*a*.
Figure 4:
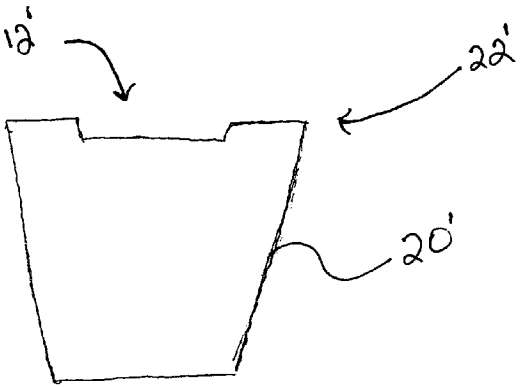
FIG. 4 is a schematic representation of a side view of another embodiment of the mounting device of the present invention.
Figure 4A:
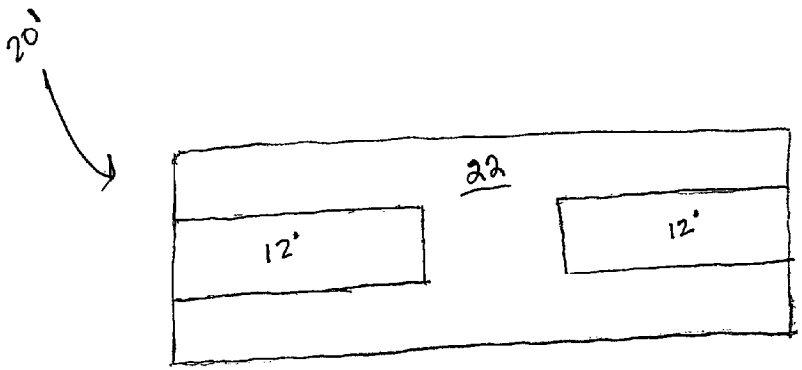
FIG. 4*a* is a schematic representation of a top view of the mounting device in the embodiment of FIG. 4.

Further, in at least one preferred embodiment of the present invention, the support assembly 10 may include at least one but more practically a plurality of mounting devices 20 and at least one overlying member 40, such as a panel and/or platform. As shown in FIG. 1, the mounting devices 20 may include an upper portion 22 and an attachment mechanism 30. As will be described in greater detail below, the attachment mechanism 30 may be structured to be connected to the base structure 50, as shown in FIGS. 3, 3*a*, and 3*b*. Accordingly, the attachment mechanism 30 of the present invention may be structured to be operatively disposed in an at least partially overlying manner to an external surface of the base structure 50. In addition, as will also be described in greater detail below, the attachment mechanism 30 may be temporarily or at least partially permanently secured to the base structure 50.

Moreover, the attachment mechanism 30 in at least one embodiment of the present invention may include at least one, but preferably two spaced apart, outwardly extending members, such as legs 34. The legs 34 may be operatively connected in a spaced apart relation by member 32 disposed therebetween, defining a channel 38 therein. As shown in FIG. 3 and described below, the channel 38 may be dimensioned and configured to facilitate the connection of the mounting device 20 to the base structure 50. More in particular, the channel 38, may be structured to cooperatively receive the base 50 therein.

Additionally, in at least one embodiment of the present invention, as shown in FIG. 1, the attachment mechanism 30 may include an irregular surface configuration which may at least partially be defined by teeth 36 disposed on an inner surface of the channel 38. Further, the irregular surface configuration, or teeth 36, may be disposed in engaging confronting relation with the base structure 50. Moreover, the teeth 36 may operate to facilitate the gripping engagement between the attachment mechanism 30 and the base structure 50. Specifically, the teeth 36 may at least partially grip and/or frictionally engage the surface of the base structure 50 to securely connect the attachment mechanism 30 thereon.

Furthermore, the attachment mechanism 30 may also include a tightening assembly 14 structured to further facilitate the connecting of the attachment mechanism 30 to the base structure 50. As shown in FIG. 1, at least one of the legs 34 may be structured to define a bore 15 extending completely therethrough. As such, the tightening assembly 14 may include a fastener 16 structured to be cooperatively disposed within the bore 15 and comprising a sufficient length to pass completely therethrough and into engaging contact with the base structure 50.

The fastener 16 of the present invention may include a conventional screw such that the use of a screw driver or other like device may be needed to operatively tighten and/or loosen the screw. In addition, a thumb screw or other similar structure may preferably be utilized to effectively eliminate the need for tools or other such external devices.

Moreover, the fastener 16 may be structured to operatively penetrate the surface of the base structure 50 to facilitate an at least partially permanent connection of the attachment mechanism 30 thereto. On the other hand, however, the fastener 16 may be structured to merely engage the surface of the base structure 50 by way of pressure or friction. Further, however, rather then a fastener 16, the tightening assembly 14 may comprise any other structure such as a ratcheting mechanism to securely connect or engage the attachment mechanism 30 to the base structure 50.

Figure 1A:
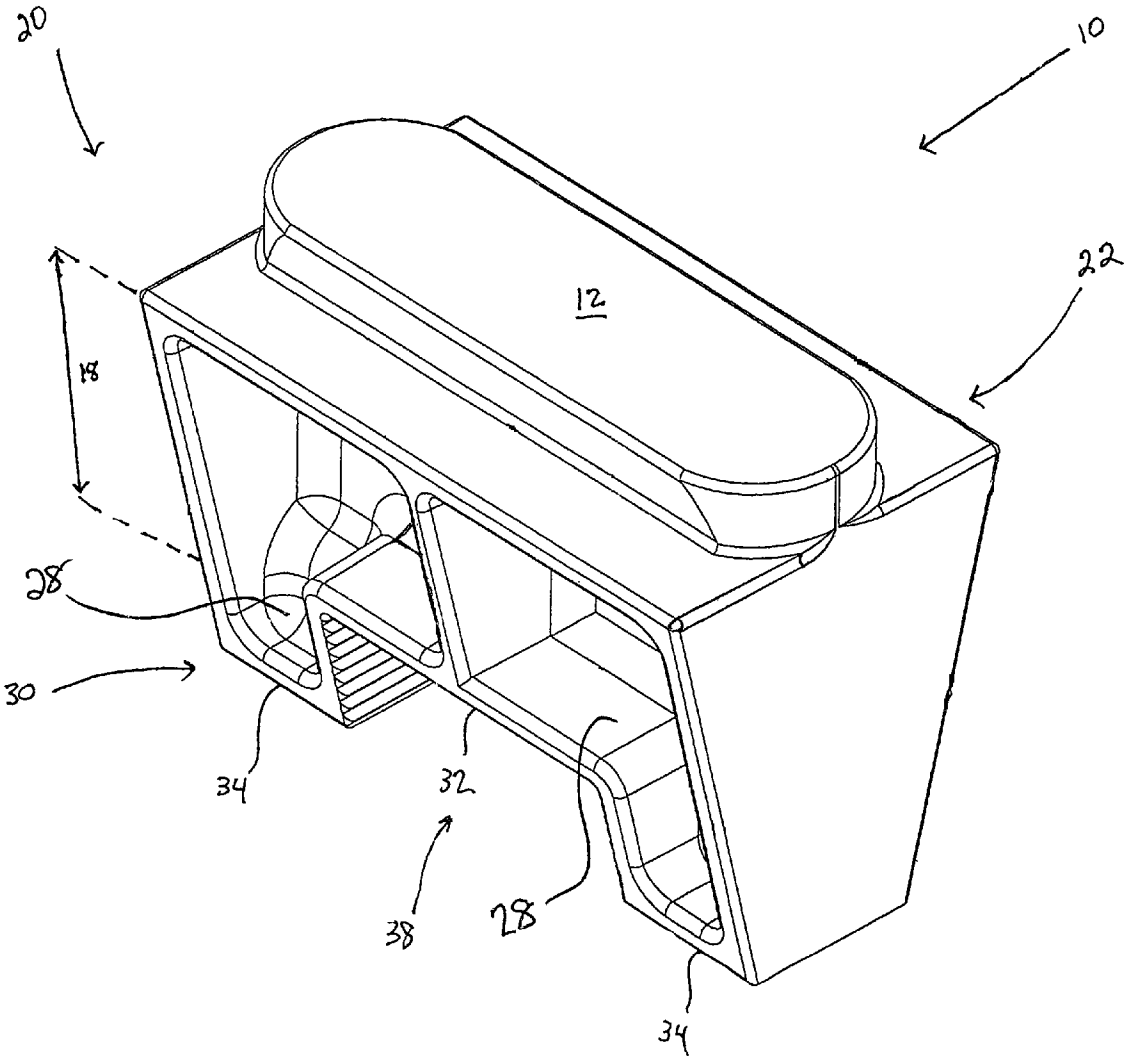
FIG. 1*a* is a schematic representation of another embodiment of a mounting device of the present invention.
Figure 1B:
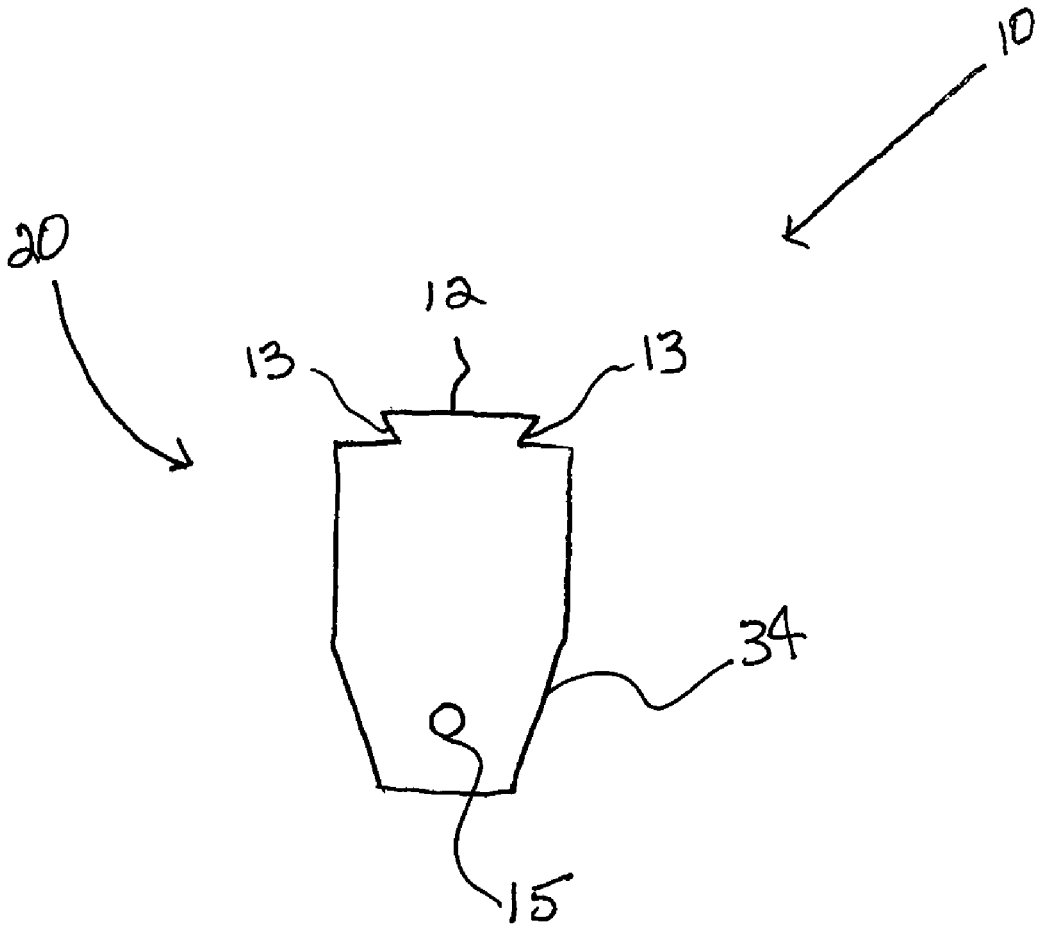
FIG. 1*b* is a schematic representation of an end view of the mounting device of FIG. 1*a*.

Still referring to FIGS. 1 and 1*a*, the upper portion 22 of the mounting device 20 of the present invention may include an outwardly projecting portion such as at least one raised tab 12. The raised tab 12 may be structured to extend substantially along the length of the upper portion 22 of the mounting device 20. In at least one embodiment of the present invention, the raised tab 12 may comprise an at least partially outwardly angled configuration. For example, the raised tab 12 may be at least partially defined by at least one, but more practically two, projecting side walls 13 extending along the length thereof. As best shown in FIG. 1*b*, the side walls 13 of the raised tab 12 may, but need not be at least partially angled in an outwardly orientation. Accordingly, the raised tab 12 may at least partially comprise a dove-tail configuration.

Figure 1C:
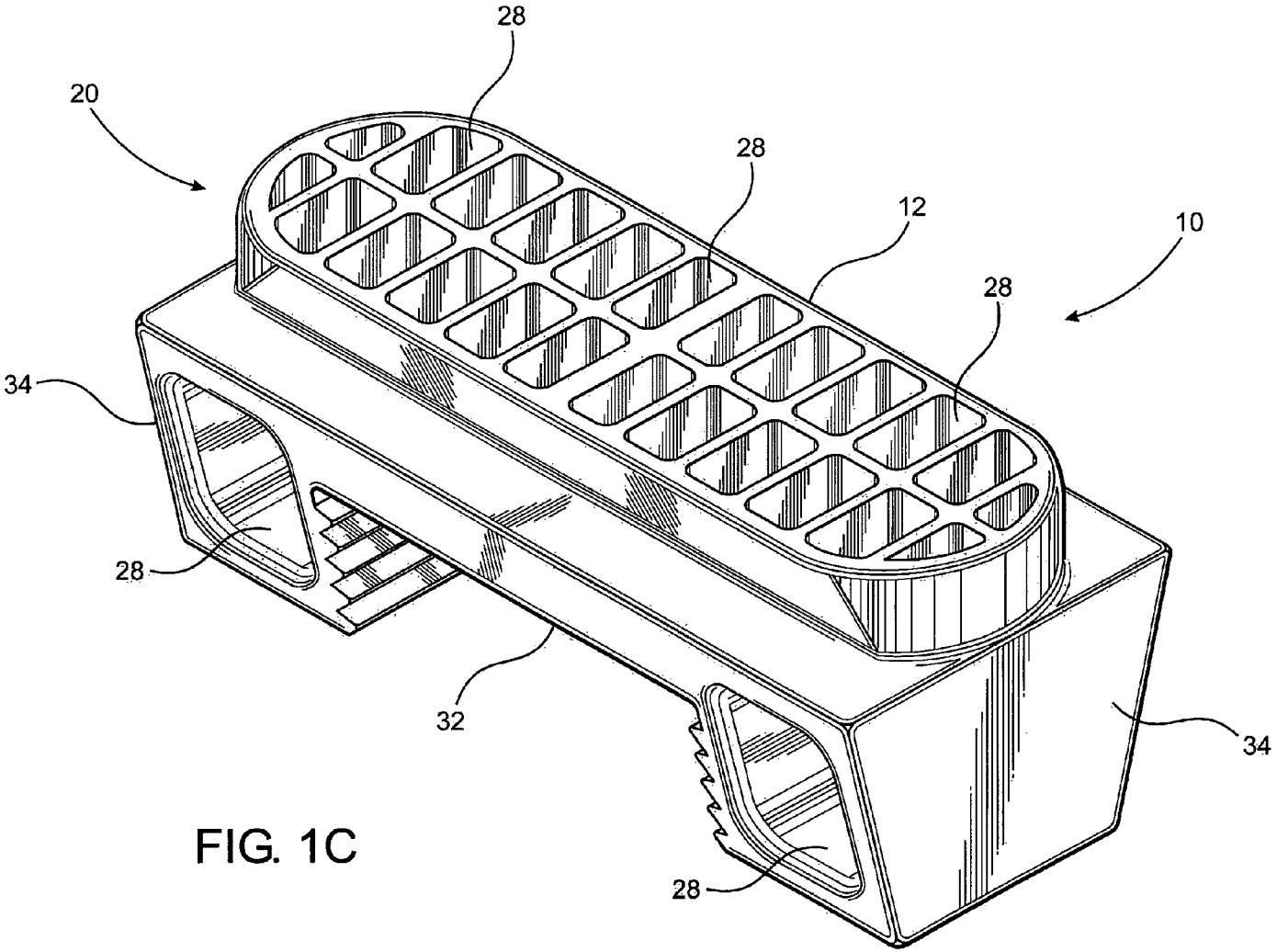
FIG. 1*c* is a schematic representation of another embodiment of a mounting device of the present invention.

In addition, the mounting devices 20 of the support assembly of the present invention may, but need not include at least one or a plurality of inwardly extending cavities 28. The cavities 28 are primarily structured to facilitate the manufacturing and/or molding process of the mounting devices 20 of the present invention. More in particular, as shown in FIGS. 1 and 1*a*, the cavities 28 may be disposed on or near the outwardly extending members, or legs 34. In addition, as illustrated in FIG. 1*c*, the cavities 28 may be disposed on the outwardly protruding portion, or raised tab 12.

As shown in FIGS. 2, 2*a*, 2*b* and 2*c*, and as also mentioned above, the support assembly 10 of the present invention may further include at least one overlying member 40 having an upper surface 45 and a lower surface 46. The overlying member 40 may comprise a substantially rigid construction, and may preferably be constructed from particle board, however, other materials may be utilized, such as, plywood, medium-density fiberboard (MDF or MDFB), metal, plastic, or other like materials. Moreover, the overlying member 40 of the present invention may comprise any sufficient rigidity to at least partially support the particular load, if any, for its intended purpose.

Furthermore, the overlying member 40 of the present invention may be constructed in any of a plurality of dimensions, depending on the specific use, location, and/or requirements of the particular user. For example, it is common for the open spaces between the bottom chords of the trusses on the floor of an attic to have a width and/or length of about sixteen (16) inches or twenty four (24) inches on center, however, any dimension may be contemplated. Moreover, the overlying member 40 of the support assembly 10 may be cooperatively dimensioned to be disposed in overlying relation thereto.

Similarly, the thickness of the overlying member 40 may vary in dimension depending on the specific use, location, and/or requirements of the particular user. For example, the overlying member 40 may preferably have a thickness of about between ¾ inches and ⅝ inches. However, since the use of the support assembly 10 of the present invention is not limited to the floors in an attic, the overlying member 40 may be constructed into many different lengths, widths, and/or thicknesses, including for example, a universal and/or adjustable size.

Figure 2:
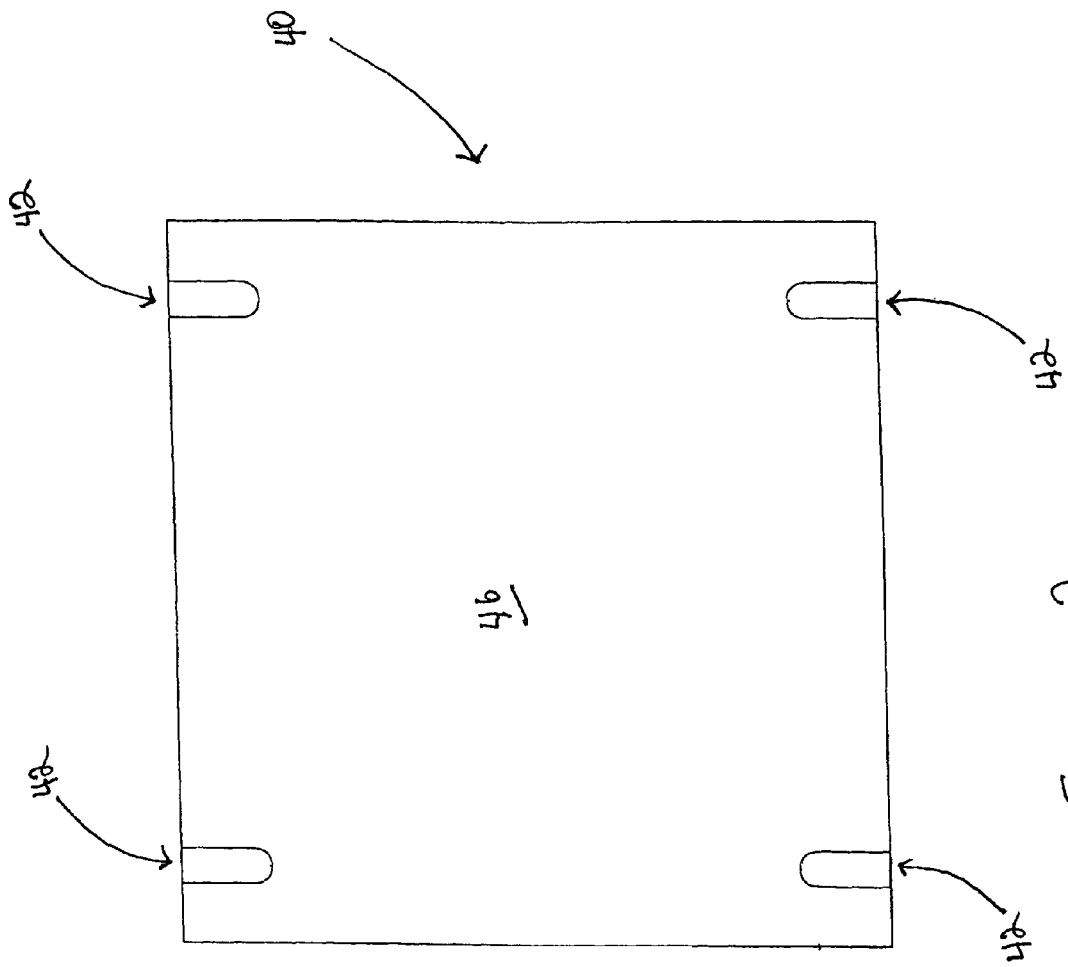
FIG. 2 is a schematic representation of a bottom view of a preferred embodiment of an overlying member of the present invention.
Figure 2A:
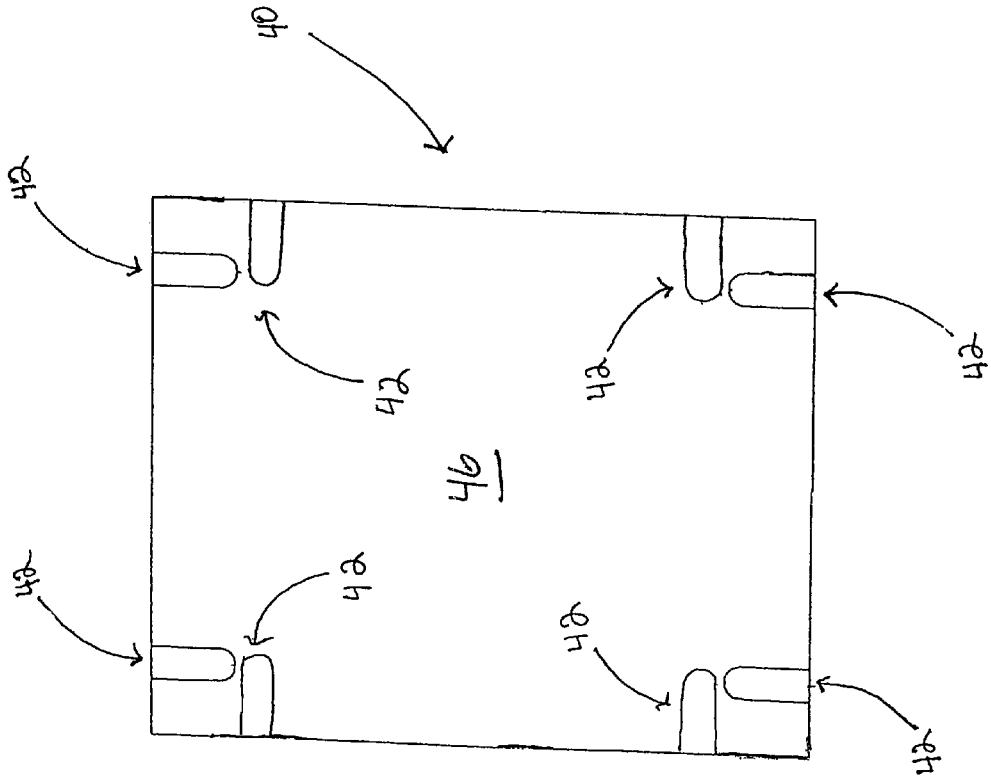
FIG. 2*a* is a schematic representation of a bottom view of at least one embodiment of an overlying member of the present invention.
Figure 2B:
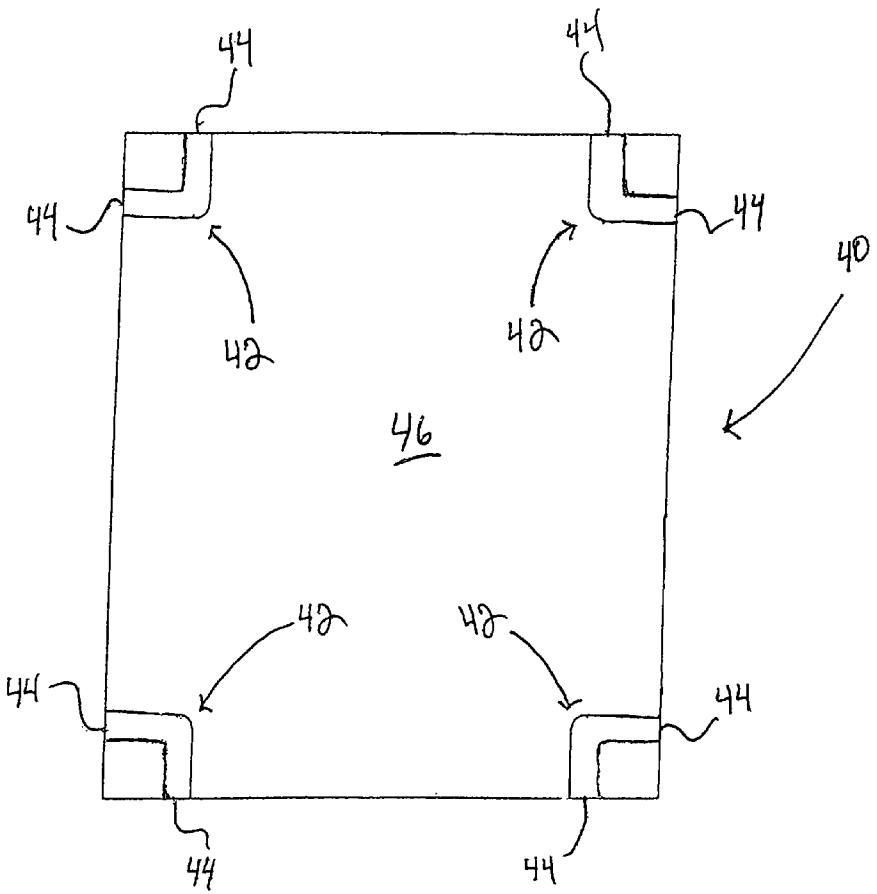
FIG. 2*b* is a schematic representation of a bottom view of at least one embodiment of an overlying member of the present invention.

In at least one preferred embodiment of the present invention, as shown in FIGS. 2, 2*a*, and 2*b*, the lower surface 46 of the overlying member 40 may be structured to define at least one or a plurality of receiving slots 42. More in particular, the receiving slots 42 of the overlying member 40 may be cooperatively dimensioned and structured to be removably securable to the raised tabs 12 of the mounting devices 20.

As best shown in FIGS. 2, 2*a*, and 2*b*, the receiving slots 42 may be disposed substantially near the edges of the lower surface 46 of the overlying member 40. However, it is contemplated that the receiving slots 42 may instead be disposed anywhere along or on the lower surface 46, for example, closer to the center thereof. More in particular, as illustrated in FIG. 2*b*, the receiving slots 42 may be structured to form an at least partially L-shaped configuration. The L-shaped receiving slots 42 may be structured to operatively receive the outwardly protruding portion, or raised tab 12 of the mounting devices 20, from either one and/or both ends 44 thereof.

As such, the overlying member 40 may be utilized and/or disposed in a plurality of orientations, depending on the particular distance between the relative base structures 50. More in particular, as previously described above, each of the beams, joists, or bases of the trusses in an attic may commonly be disposed a distance of sixteen (16) or twenty-four (24) inches on center, however any dimensions or distances may be used. Accordingly, the overlying member 40 may be universally dimensioned such that the width of the overlying member 40 is structured to facilitate the support assembly 10 to be used with at least one spaced apart dimension of the base structures 50 and the length of the overlying member 40 is structured to facilitate the support assembly 10 to be used with another spaced apart dimension of the base structures 50.

Figure 2C:
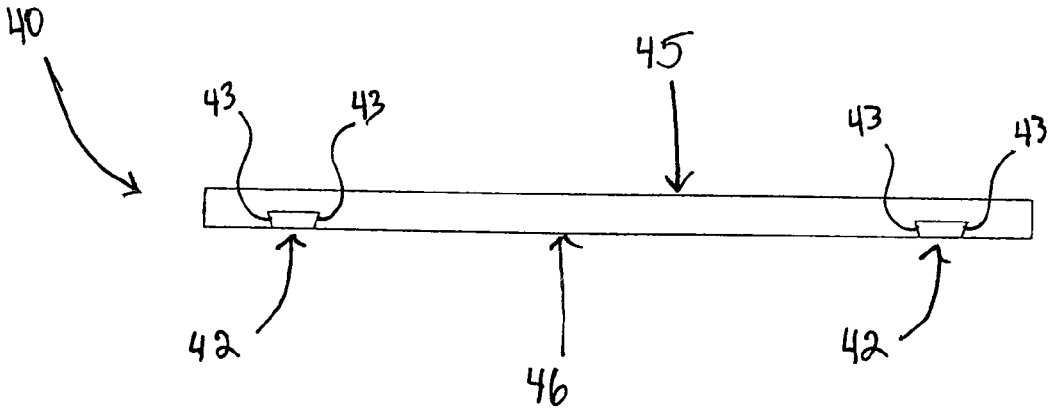
FIG. 2*c* is a schematic representation of a front view of the overlying member of FIG. 2.

Further, in at least one embodiment of the present invention, the receiving slots 42 may include at least one, but more practically at least two, side walls 43. As best shown in FIG. 2*c*, the side walls 43 may comprise an at least partially angled configuration relative to upper and lower surfaces 45 and 46. Moreover, the side walls 43 of the receiving slots 42 may preferably be cooperatively structured with the orientation of the side walls 13 of the raised tabs 12 so as to create an at least partially locking and/or cooperative relationship therewith. In addition, the receiving slots 42 and the raised tabs 12 may be cooperatively structured to form a sliding engagement therewith. However, the raised tabs 12 may instead or additionally be insertable or engageable with the receiving slots 42 in a plurality of manners, for example, to facilitate a snap-like engagement therewith.

As illustrated in FIG. 3, the support assembly 10 of the present invention may be operatively disposed in an overlying relation to the base structure 50. Specifically, the base structure 50 may be received by the channel 38 so as to be cooperatively disposed in a confronting relation with the outwardly extending members 34 and member 32. In addition, FIG. 3 illustrates two overlying members 40 operatively connected to the outwardly protruding portion 12 of the mounting device 20.

Furthermore, referring again to FIGS. 1 and 1*a*, and as also shown in FIG. 3, the mounting devices 20 of the present invention each include an elevation height 18 defined by the distance between member 32 and upper portion 22. The elevation height 18 of the mounting devices 20 is preferably dimensioned and configured to dispose the overlying member 40 above and/or in an outwardly spaced relation from the base structure 50. The elevation height 18 may be minimal, as shown in FIG. 1. However, any elevation height 18 may be implemented, such as, for example, a larger elevation height as shown in the embodiment of FIG. 1*a*.

Moreover, as shown in FIGS. 3*a* and 3*b*, the elevation height 18 may be dimensioned to dispose the overlying member 40 a sufficient distance from the base structure 50 to define an opening 60 configured to facilitate the placement of pipes, wiring, and/or other utilitarian devices between the base structure 50 and the corresponding overlying member 40. More in particular, because the lower surface 46 of the overlying member 40 of the present invention may either be substantially flat, as shown in FIG. 3*a*, or at least partially downwardly protruding, as shown in FIG. 3*b*, the opening 60 may vary in dimension.

As shown in FIGS. 4, 4*a*, 5, and 5*a*, in at least one alternative embodiment of the present invention, the support assembly 10 may comprise a substantially "reversed" structural configuration for connecting the one or more mounting devices 20 to the one or more overlying members 50. Specifically, referring to FIGS. 4 and 4*a*, the upper portion 22' of the mounting devices 20' may be structured to define at least one or a plurality of receiving slots 12' thereon. The receiving slot(s) 12' may be disposed substantially near the edges of the mounting device 20', or closer to the center thereon.

Figure 5:
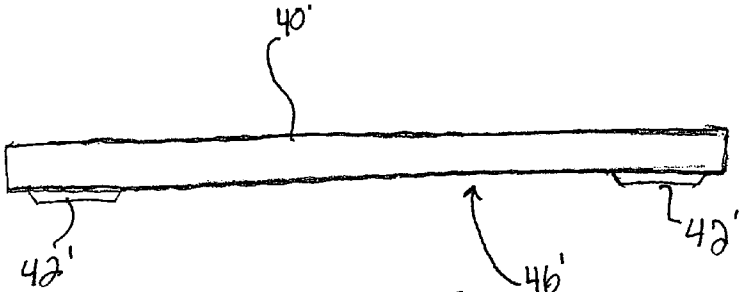
FIG. 5 is a schematic representation of a front view of another embodiment of the overlying member of the present invention.
Figure 5A:
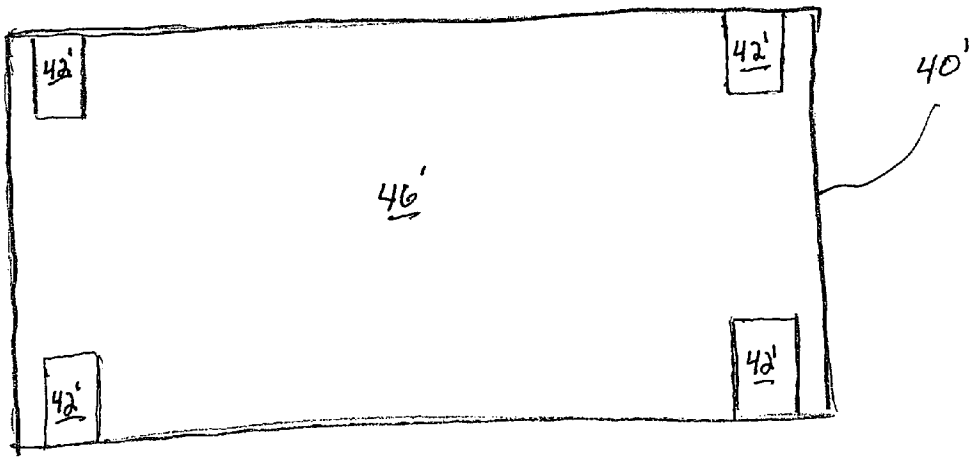
FIG. 5*a* is a schematic representation of a bottom view of the overlying member in the embodiment of FIG. 5.

In addition, referring now to FIGS. 5 and 5*a*, the lower surface 46' of the overlying member 40' may include at least one or a plurality of cooperatively structured and disposed tabs 42' thereon. As such, tabs 42' of the overlying member 40' may be cooperatively disposed, for example, insertable within the receiving slots 12' of the mounting devices 20'. More in particular, the tabs 42' of the overlying member 40' may be slidingly engageable with the cooperatively disposed receiving slots 12' of the mounting devices 20'. However, the tabs 42' may be cooperatively engaged with the receiving slots 12' in a plurality of manners including, but not limited to, a snap fit.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A support assembly connectable to a base structure, the base structure comprising a plurality of spaced apart beams, said support assembly comprising:

a plurality of mounting devices each comprising at least one outwardly protruding portion, said mounting devices further comprising an attachment mechanism removably connectable to the base structure, a plurality of overlying members collectively disposed in an adjacent, end-to-end relation to one another to form a substantially continuous support assembly, each of said plurality of overlying members comprising an upper surface and a lower surface, said lower surface of said overlying members comprising a plurality of elongated receiving slots thereon, at least one of said plurality of elongated receiving slots comprising an open end common with an adjacent, facing peripheral edge of said adjacently disposed overlying members, said outwardly protruding portion of at least one of said plurality of mounting devices being concurrently connected to said adjacently disposed overlying members, and said outwardly protruding portion of each of said plurality of mounting devices being disposed in a slidable relation horizontally into and out of a corresponding one of said plurality of elongated receiving slots.

2. A support assembly connectable to a base structure as recited in claim 1 wherein each of said outwardly protruding portions comprises a raised tab.

3. A support assembly connectable to a base structure as recited in claim 1 wherein said outwardly protruding portion of each of said plurality of mounting devices is freely disposed in a slidingly engageable relation within a corresponding one of said plurality of elongated receiving slots.

4. A support assembly connectable to a base structure as recited in claim 1 wherein said attachment mechanism comprises at least two outwardly extending members.

5. A support assembly connectable to a base structure as recited in claim 4 wherein said outwardly extending members comprise legs.

6. A support assembly connectable to a base structure as recited in claim 1 wherein each of said plurality of mounting devices comprises an elevation height.

7. A support assembly connectable to a base structure as recited in claim 6 wherein said elevation height is dimensioned and configured to dispose the overlying member in an outwardly spaced relation from the base structure.

8. A support assembly connectable to a base structure as recited in claim 1 wherein said attachment mechanism comprises a tightening assembly.

9. A support assembly connectable to a base structure as recited in claim 8 wherein said tightening assembly comprises a fastener.

10. A support assembly connectable to a base structure, the base structure comprising a plurality of spaced apart beams, said support assembly comprising:

a plurality of mounting devices each comprising at least one outwardly protruding portion, each of said plurality of mounting devices further comprising an attachment mechanism disposed in a removably connected relation to the base structure, and a plurality of overlying members collectively disposable in an adjacent, end-to-end relation to one another to form a substantially continuous support assembly, each of said plurality of overlying member comprising an upper surface and a lower surface, said lower surface comprising a plurality of elongated receiving slots embedded partially within said overlying member wherein said upper surface comprises a continuously flat, planar configuration, wherein said plurality of mounting devices and said plurality of elongated receiving slots are cooperatively structured and disposed to horizontally removably and universally connect said overlying member to adjacent ones of the plurality of spaced apart beams in either of at least two supported orientations, said at least two supported orientations being defined and distinguishable by a variable spacing between the adjacent beams.

11. A support assembly connectable to a base structure as recited in claim 10 wherein said outwardly protruding portion of each of said plurality of mounting devices is disposed in a non-obstructive slidable relation into and out of a corresponding one of said plurality of elongated receiving slots.

12. A support assembly connectable to a base structure as recited in claim 10 wherein each of said plurality of mounting devices are selectively disposed within said receiving slots to selectively connect said overlying member to the adjacent beams in any one of said at least two supported orientations.

* * * * *